US008881802B2

(12) United States Patent
Gorman

(10) Patent No.: US 8,881,802 B2
(45) **Date of Patent: *Nov. 11, 2014**

(54) DEBRIS BARRIER FOR PACKER SETTING SLEEVE

(75) Inventor: Benjamin J. Gorman, Evergreen, CO (US)

(73) Assignee: Baker Hughes Incorporated, Houston, TX (US)

( * ) Notice: Subject to any disclaimer, the term of this patent is extended or adjusted under 35 U.S.C. 154(b) by 135 days.

This patent is subject to a terminal disclaimer.

(21) Appl. No.: 13/307,700

(22) Filed: Nov. 30, 2011

(65) Prior Publication Data

US 2013/0133879 A1 May 30, 2013

(51) Int. Cl.
*E21B 23/00* (2006.01)

(52) U.S. Cl.
USPC ..... 166/202; 166/179

(58) Field of Classification Search
USPC ..... 166/99, 118, 179, 191, 202, 227
See application file for complete search history.

(56) References Cited

U.S. PATENT DOCUMENTS

| | | | | |
|---|---|---|---|---|
| 5,318,117 | A | 6/1994 | Echols, III et al. | |
| 6,019,126 | A | 2/2000 | Kelda | |
| 6,065,485 | A * | 5/2000 | Rooker | 137/68.26 |
| 6,186,227 | B1 | 2/2001 | Vaynshteyn et al. | |
| 6,382,324 | B1 | 5/2002 | Anyan | |
| 6,883,605 | B2 | 4/2005 | Arceneaux et al. | |
| 7,011,157 | B2 | 3/2006 | Costley et al. | |
| 7,540,323 | B2 | 6/2009 | McAnally | |
| 7,604,048 | B2 | 10/2009 | Kossa et al. | |
| 7,604,050 | B2 | 10/2009 | Dallas et al. | |
| 7,882,903 | B2 | 2/2011 | Barnett | |
| 7,905,280 | B2 | 3/2011 | Mills | |
| 2003/0089505 | A1 | 5/2003 | Pluchek et al. | |
| 2004/0221984 | A1 | 11/2004 | Cram | |
| 2007/0062690 | A1 | 3/2007 | Witcher | |
| 2008/0314600 | A1 | 12/2008 | Howard et al. | |
| 2009/0200030 | A1 * | 8/2009 | Mills | 166/298 |
| 2010/0032167 | A1 | 2/2010 | Adam et al. | |
| 2011/0168387 | A1 | 7/2011 | O'Malley | |

FOREIGN PATENT DOCUMENTS

| | | |
|---|---|---|
| WO | 9939077 | 8/1999 |
| WO | 2010097616 | 9/2010 |

* cited by examiner

*Primary Examiner* — David Andrews
*Assistant Examiner* — Taras P Bemko
(74) *Attorney, Agent, or Firm* — Steve Rosenblatt

(57) ABSTRACT

An annular seal for a setting tool in a packer tieback extension comprises a downhole oriented packer cup assembly. As the tool is run in the hole the packer cup flexes as the rising hydrostatic pressure equalizes across the cup into what started as a zone with atmospheric pressure inside the packer tieback extension. Once the pressure is equalized the self energizing feature of the packer cup maintains grit and debris in the mud from entering the tieback extension where the spring loaded dogs of the setting tool are held in a retracted position. If the seal fails to equalize and allows a large differential across the setting sleeve from the surrounding annulus, the rupture disc breaks inwardly into the tieback extension so that pressure is equalized. If the packer is never set after being lowered to depth and the pressure from the tieback extension is equalized into the annulus.

19 Claims, 1 Drawing Sheet

DEBRIS BARRIER FOR PACKER SETTING SLEEVE

FIELD OF THE INVENTION

The field of the invention is packers for subterranean use and more particularly mechanically set packers that need debris exclusion from a tieback extension or polished bore receptacle while having a backup for avoiding collapse of the setting sleeve when pressure fails to equalize for run in and to vent trapped pressure when pulling out of the hole.

BACKGROUND OF THE INVENTION

In certain applications packers such as line top packers may need to be in a wellbore for days while being repositioned to accommodate other procedures. During this time the running tool that will ultimately set the packer is used to reposition the packer and the liner associated with the packer. When the time comes to set such a packer the running tool is released from the assembly, then picked up relative to the packer to allow spring loaded dogs to extend above the packer tieback extension so that a subsequent setting down weight will push the tieback extension to set the packer. The problem in some environments where the wellbore fluid has fine grit or solid particles is that in the course of the time that the packer is manipulated in the well before it is set the fine debris in the drilling mud can migrate into the setting sleeve and foul the spring-loaded dog mechanism to the point that the dogs will not extend when pulled free of the tieback extension and subsequent setting down weight will not set the packer because such force will not be transmitted to the tieback extension. If the debris accumulation is severe enough within this annulus, it can also cause difficulty even achieving this upward movement of the setting tool, and prevent release of the workstring (drill pipe or tubing) from the liner assembly.

Prior designs have recognized the need to exclude debris from the setting sleeve to avoid fouling the spring loaded dog mechanism and have approached the problem with two split segments that are attached to each other and span over a part of the annular gap between the setting tool mandrel and the tieback extension of the packer. This solution has not been optimal because where the grit in the mud is rather fine there was still solids migration beyond the barrier and the setting dogs jammed in the retracted position when pulled out of the tieback extension rather than springing out so that on setting down they could bear on the top of the tieback extension for setting the packer.

U.S. Pat. No. 7,604,048 developed a folding debris barrier 30 that was set after the packer set by the application of a further set down weight. It remained retracted with the packer unset and is thus not a workable solution to a situation of long term grit exposure in an unset condition as is envisioned for the debris barrier needs for the present packer application.

Another solution for sealing a mandrel in a seal bore is offered in US Publication 20110168387 is to use a foam material that fully spans an annular gap and is reported to enable pressure equalization through the open structure of the foam. The potential problem with this design is that it may plug with particulates internally and will fail to equalize pressure. The material can also have temperature and mechanical strength issues that could preclude using it for packer setting sleeve purposes in harsh grit-laden environments.

Packer cups have been used as debris barriers and have been oriented uphole to accumulate debris within the cup. Such orientation prevents pressure equalization from above to below the uphole oriented packer cup. Some examples of such a design are: US Publication 2003/0089505; WO2010/097616; U.S. Pat. Nos. 7,604,050; 7,540,323 and 7,011,157. Some designs allow for pressure equalization through debris catching packer cups by putting holes or ports in them or exposing mandrel ports near such packer cups, such as U.S. Pat. Nos. 7,882,903; 6,186,227; US Publication 2008/0314600 or US Publication 2007/0062690.

Combination pressure and vacuum devices have been used for large storage tanks that are responsive to relieve internal pressure and vacuum in the storage tank as it is filled or emptied. Such designs are shown in FIG. 4 in U.S. Pat. No. 6,019,126 but are too large and unwieldy for subterranean use and are not built to withstand the pressures normally seen in subterranean wellbores.

What is needed and provided by the present invention is a debris barrier that has the capability of pressure equalization as the tool is delivered so that a zone that starts at atmospheric pressure when run into the wellbore can equalize with well hydrostatic as such hydrostatic pressure increases with additional depth for the tool. The same barrier that allows such pressure equalization also has the capability of excluding even fine grit by its self energizing configuration after pressure equalization has occurred. If there is a failure of the equalization feature a dual acting rupture disc is provided. In one direction it can prevent collapse of the downhole tool due to large pressure differentials by letting the hydrostatic pressure rupture the disc inwardly to relieve the high differential pressure before the setting sleeve collapses. In some instances the packer has to be removed without being set and while it is still attached to the running tool. This can create a volume of trapped high pressure that can injure surface personnel if that pressure is not relieved before component disassembly. The dual acting rupture disc responds to a growing differential from within the tool to the surrounding annulus as the tool is removed from the wellbore. At some depth the differential as between inside the tool and the surrounding annulus is high enough to burst the disc in the outward direction toward the annulus. That way when the packer comes out of the hole there is no trapped pressure inside. These and other aspects of the present invention will become more readily understandable from a review of the detailed description and the associated figures while understanding that the full scope of the invention is to be found in the appended claims.

SUMMARY OF THE INVENTION

An annular seal for a setting tool in a packer tieback extension comprises a downhole oriented packer cup assembly. As the tool is run in the hole the packer cup flexes as the rising hydrostatic pressure equalizes across the cup into what started as a zone with atmospheric pressure inside the packer setting sleeve. Once the pressure is equalized the self energizing feature of the packer cup maintains grit and debris in the mud from entering the setting sleeve where the spring loaded dogs of the setting tool are held in a retracted position. If the seal fails to equalize and allows a large differential across the setting sleeve from the surrounding annulus then the dual acting rupture disc breaks inwardly into the setting sleeve so that pressure is equalized. If the packer is never set after being lowered to depth and the pressure from the setting sleeve has to be equalized into the annulus or else there is a chance that such trapped pressure will remain if the tool is later disassembled at the surface. The dual acting rupture disc breaks outwardly as the unset packer with the running tool are removed together. Any trapped pressure is thus relieved as the packer is removed so that surface personnel will not be injured when disassembling the packer and setting tool combination.

DETAILED DESCRIPTION OF THE PREFERRED EMBODIMENT

Figure 1:
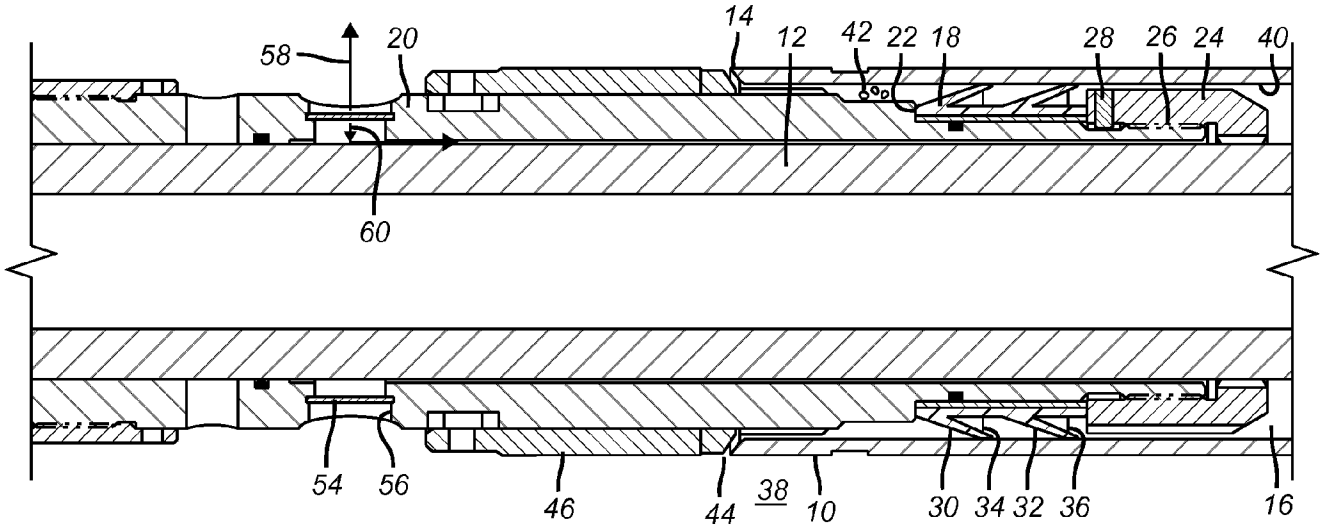
FIG. 1 shows a section view of the setting tool in the setting sleeve before the packer is set further showing the seal and the rupture disc placement.
Figure 2:
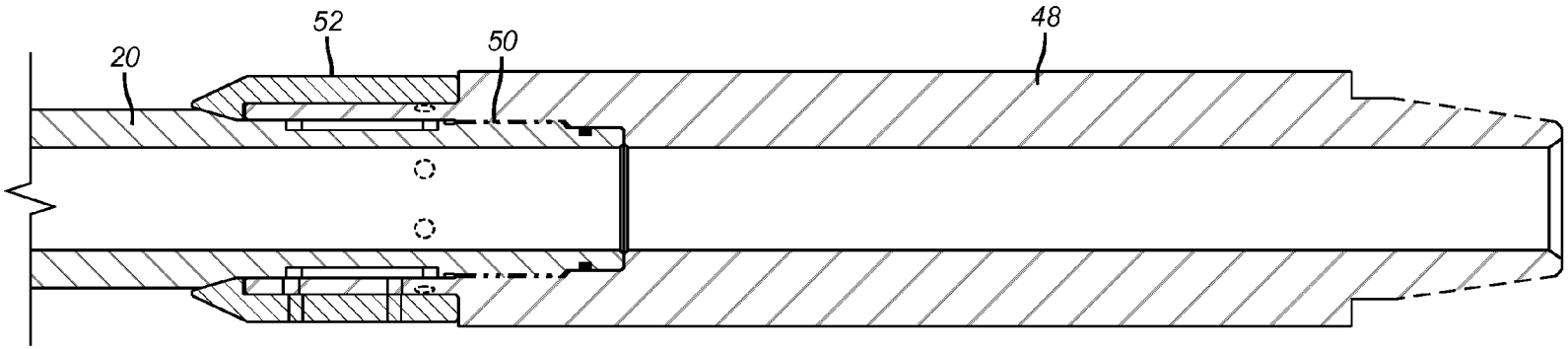
FIG. 2 is a view of a multi-component hub for the seal of FIG. 1.

FIG. 1 illustrates a tieback extension 10 that is part of a known packer design that can be attached to a liner top. Other applications are intended but the preferred embodiment seeks to keep debris from entering the tieback extension 10 as well as protecting the tieback extension 10 against inward collapse due to an unusual differential pressure situation arising as will be explained below. Removal of the tieback extension 10 with the associated packer that is not shown also allows trapped pressure in tieback extension 10 to equalize with annulus pressure so that personnel will not be injured by trapped high pressure when disassembling the setting tool from the tieback extension 10 in the event the packer is not deployed and is retrieved with the setting tool, as will also be explained below.

Mandrel 12 is part of the setting tool and is connected to the packer setting dog sub which encompasses the spring loaded dogs that reside in tieback extension 10 in a retracted condition. The packer is set in the known way by raising the dogs out of tieback extension 10 to allow them to spring out and then setting down the dogs on the top 14 of the tieback extension 10 with that motion then setting the packer. If fines, grit or debris accumulates in annular volume 16 where the retracted spring-loaded dogs reside and get into the mechanisms then there is a chance that the dogs will not extend when pulled out of the tieback extension 10 and setting the packer will not be possible. It may also become impossible to even release the setting tool from the liner if the accumulation is severe enough. To keep annular volume 16 relatively debris free a seal assembly 18 is provided and mounted to outer mandrel 20 between shoulder 22 and end ring 24 that is attached to mandrel 20 at thread 26 with the connection secured against being unthreaded by a pin or pins 28. The seal assembly 18 preferably comprises multiple packer cups 30 and 32 arranged to have their respective ends facing downhole, which means in a direction away from a surface location. Although two cups are shown one or more than two can be used with open ends 34 and 36 looking downhole.

Initially on assembly at the surface the annular volume 16 will have atmospheric pressure trapped therein and filled with a fluid or gel substance to prevent initial debris accumulation if the extension were allowed to fill with wellbore fluids on its own. As the packer with the tieback extension 10 is lowered into a wellbore the wellbore hydrostatic pressure will increase with depth in the surrounding annulus assuming there is a liquid level in the annulus. After inserting the assembly of FIG. 1 into a well for a short distance the annulus pressure greatly exceeds the trapped atmospheric pressure in annular space 16 and minimal annulus fluid flow occurs into space 16 across the cups 30 and 32 until the pressures equalize and the cups 30 and 32 go back out against wall 40 of tieback extension 10. The cups have a shape that biases them outwardly against wall 40 unless flow induced by pressure differential between annulus 38 and space 16 flexes the cups away from wall 40 as the flow continues. While some particles may get past the cups 30 and 32 when they are flexed away from wall 40, that amount is so minimal because the equalization of pressure happens so fast as the packer is run into the hole that the working of the spring loaded dogs that reside in the tieback extension 10 is not adversely affected.

Once the pressure between the annulus 38 and the annular space 16 has equalized, the cups 32 and 30 are strong enough in their contact with wall 40 to keep solids or other debris from getting past into space 16. The solids 42 will merely pile up above seal 30 as shown in FIG. 1. The solids 42 will be smaller than gap 44 created by ring 46 and the top 14 of the setting tieback extension 10. In prior designs two segments were brought together to create a gap such as 44 but in applications of very fine grit too many solids got into the gap 44. One improvement in the design shown in FIG. 1 is to use a solid ring 46 and in order to be able to mount ring 46 on the outer mandrel 20 the outer mandrel is made in pieces that are assembled after the ring 46 is in position. With the ring 46 in the position of FIG. 1 the component 48 is secured to the outer mandrel 20 at thread 50 and that connection is held together with ring 52. If this assembly were a single piece then the ring 46 would need to be in pieces as in the past. With the components of the outer mandrel 20, 48 as described above, the ring 46 can be slipped over an end of 20 before the other component 48 is secured to 20.

If for any reason there is no pressure equalization past seals 30 and 32 as the packer is run into the hole then trapped atmospheric pressure can remain in space 16 as the hydrostatic pressure in annulus 38 near the tieback extension 10 increases. In very deep wells or wells with high density wellbore fluids the differential pressure between the annulus 38 hydrostatic and atmospheric pressure inside space 16 can cause tieback extension 10 to inwardly collapse. If this happens the setting tool will not be able to set the packer and separating the setting tool outer mandrel 20 from the tieback extension 10 in a nondestructive way may also become a problem. This collapse situation is avoided by providing one or more dual action rupture discs 54 in respective ports 56. To prevent collapse of tieback extension 10 inwardly the discs 54 will break inwardly in the direction of arrow 60 to let pressure in the annulus 38 get into space 16 so that pressure is equalized with respect to the inside and the outside of tieback extension 10.

On the other hand there could be occasions where the packer is run in and never set so that the mandrel 20 comes out of tieback extension 10 for the setting as described above and then the running/setting tool with its mandrel 20 are pulled out. In the event that the tieback extension 10 and the mandrel 20 come out of the hole together, there is a high possibility that hydrostatic pressure is trapped in annular space 16 because the seals 30 and 32 are designed to let hydrostatic pressure into space 16 to avoid collapse of tieback extension 10 on run in but the downhole orientation of the cup seals 30 and 32 prevents fluid from traveling out of space 16 once past the seals 30 and 32. For those occasions the dual acting rupture disc 54 will break in the direction of arrow 58 as the mandrel 20 is raised in the wellbore still attached to tieback extension 10. Doing this assures that there is no trapped pressure in space 16 when the assembly comes out of the hole. Without the dual acting rupture disc 54 pressure could have been trapped in space 16 and that could have been the cause for injury to personnel that tried to separate mandrel 20 from tieback extension 10. The dual acting rupture disc presents a compact solution to two potential problems in an environment where space is at a premium. One or more such rupture discs can be used and they are mounted in a port so that in effect they take up no incremental space.

Those skilled in the art will appreciate that the debris barrier and the bi-directional pressure equalization system can be applied to any confined space between a subterranean tool and a running or a running/setting tool. For the purposes of this application reference to "running tool" will encompass tools that deliver other tools as well as tools that also are configured to set another tool that was just delivered. While the preferred embodiment for seals 30 and 32 is a downhole oriented cup seal or a stack of such seals, other seal styles or seal systems that can hold back debris while allowing pressure equalization during run in are also contemplated. For example a bypass system through the seal or around the seal that is actively open as the assembly is run in and closed when the desired location is reached will be a suitable alternative. Using the downhole oriented packer cups however, eliminates the need for openings in the seals or in the mandrel around the seals or shifting the seals to expose a bypass path. The ability of the equalizing flow to simply displace the packer cups temporarily and then snap back to the debris barrier position, makes the design simpler, cheaper and more reliable. While the seals 30 and 32 are depicted as mounted to the mandrel 20 mounting the seals to the tieback extension 10 with the same downhole opening orientation is also contemplated.

The dual acting rupture disc is a space saving solution to potential collapse of tieback extension 10 and potential injury to surface personnel that disassemble the mandrel 20 from the tieback extension 10 if for some reason they come out of the hole together with trapped hydrostatic pressure between them. While the application has focused on a packer running tool where setting dogs needed to be protected from fouling with grit and debris in the drilling mud and the borehole, other applications are envisioned such as anchors or fishing tools, for example. The use of a solid rather than segmented ring 46 and its placement close to the top 14 of the tieback extension 10 also acts to limit the number of solids that can accumulate over seal 30 over time. Seal 32 acts a backup to seal 30 should there be any damage to seal 30.

The above description is illustrative of the preferred embodiment and many modifications may be made by those skilled in the art without departing from the invention whose scope is to be determined from the literal and equivalent scope of the claims below:

I claim:

1. An apparatus for protecting from debris a component of a running tool disposed within a subterranean tool being run for deployment at a subterranean location, comprising:

a running tool mandrel disposed adjacent a component of a subterranean tool to define an annular gap therebetween defining an annular space where components need to be protected from subterranean debris;

a self-actuating seal assembly spanning said annular gap for contact with said component during the entire running in from a surface location to the subterranean location except during pressure equalization, said seal assembly comprising a sealing member that allows flow into said annular space as the subterranean tool is run in to equalize initially lower pressure in said annular space with increasing surrounding hydrostatic pressure to reduce differential pressure on the component of the subterranean tool;

said annular space, which is closed to flow toward the subterranean location surrounding said mandrel by said seal assembly, is selectively communicated through at least one mandrel wall opening always fully exposed to pressure in said annular space as said seal assembly contacts said component, said opening is covered by a pressure sensitive barrier which is selectively fully opened by defeat of said pressure sensitive barrier automatically responding to differential pressure between pressure at said annular space and the subterranean location surrounding said mandrel at a time when the subterranean tool is run in or pulled out.

2. The apparatus of claim 1, wherein:

said seal assembly closes said gap upon equalizing surrounding hydrostatic pressure into said annular space.

3. The apparatus of claim 1, wherein:

said seal assembly prevents flow out of said annular space.

4. The apparatus of claim 1, wherein:

said seal assembly shape comprises a bias to retain said annular gap closed.

5. The apparatus of claim 1, wherein:

said seal assembly is supported by said running tool mandrel.

6. The apparatus of claim 5, wherein:

said seal assembly comprises at least one cup seal.

7. The apparatus of claim 6, wherein:

said cup seal has an open end facing into said annular space.

8. The apparatus of claim 7, wherein:

said at least one cup seal comprises a plurality of cup seals.

9. The apparatus of claim 8, wherein:

said cup seals have the same open end facing orientation.

10. The apparatus of claim 9, wherein:

said running tool mandrel further comprises a continuous ring mounted to said mandrel and disposed in close proximity to said annular gap to limit the debris able to enter said annular gap.

11. The apparatus of claim 10, wherein:

said mandrel is formed from multiple components to facilitate mounting said continuous ring to said mandrel.

12. The apparatus of claim 9, wherein:

said annular space, which is closed to flow toward the subterranean location surrounding said mandrel by said seal assembly, is selectively communicated through at least one mandrel wall opening that is selectively opened by defeat of a pressure sensitive barrier in said opening, said pressure sensitive barrier responding to differential pressure between pressure at said annular space and the subterranean location surrounding said mandrel.

13. The apparatus of claim 12, wherein:

said barrier responds to pressure differentials in opposed directions.

14. The apparatus of claim 13, wherein:

said barrier comprises at least one rupture disc.

15. The apparatus of claim 1, wherein:

said running tool mandrel further comprises a continuous ring mounted to said mandrel and disposed in close proximity to said annular gap to limit the debris able to enter said annular gap.

16. The apparatus of claim 15, wherein:

said mandrel is formed from multiple components to facilitate mounting said continuous ring to said mandrel.

17. The apparatus of claim 1, wherein:

said barrier responds to pressure differentials in opposed directions.

18. The apparatus of claim 17, wherein:

said barrier comprises at least one rupture disc.

19. The apparatus of claim 1, wherein:

said component comprises a packer setting sleeve.

* * * * *